US005919744A

United States Patent [19]

Lazarowitz

[11] Patent Number: 5,919,744

[45] Date of Patent: Jul. 6, 1999

[54] TRANSPARENT DISHWASHING BAR/PASTE COMPRISING ALKYL POLYGLYCOSIDES

[75] Inventor: Virginia Lazarowitz, Hatfield, Pa.

[73] Assignee: Henkel Corporation, Gulph Mills, Pa.

[21] Appl. No.: 08/919,753

[22] Filed: Aug. 27, 1997

Related U.S. Application Data

[63] Continuation of application No. 08/613,574, Mar. 11, 1996, abandoned.

[51] Int. Cl.[6] ..... C11D 10/04; C11D 3/22; C11D 3/32; C11D 3/43

[52] U.S. Cl. ..... 510/147; 510/130; 510/133; 510/141; 510/152; 510/153; 510/155; 510/156; 510/158; 510/220; 510/221; 510/224; 510/470; 510/481; 510/483; 510/491; 510/501

[58] Field of Search ..... 510/130, 133, 510/141, 147, 152, 153, 155, 156, 158, 220, 221, 224, 470, 481, 483, 491, 501

[56] References Cited

U.S. PATENT DOCUMENTS

| | | | |
|---|---|---|---|
| 4,483,780 | 11/1984 | Llenado | 252/135 |
| 4,874,538 | 10/1989 | Dawson et al. | 252/117 |
| 5,096,608 | 3/1992 | Small et al. | 252/132 |
| 5,174,927 | 12/1992 | Honsa | 252/543 |
| 5,227,086 | 7/1993 | Kacher et al. | 252/112 |
| 5,244,593 | 9/1993 | Roselle et al. | 252/99 |
| 5,266,690 | 11/1993 | McCurry, Jr. et al. | 536/18.6 |
| 5,338,491 | 8/1994 | Connor et al. | 252/548 |
| 5,496,489 | 3/1996 | Dussault et al. | 252/134 |
| 5,565,146 | 10/1996 | Jakubicki et al. | 510/235 |

*Primary Examiner*—Mark Kopec
*Assistant Examiner*—Charles Boyer
*Attorney, Agent, or Firm*—Ernest G. Szoke; Wayne C. Jaeschke; Steven J. Trzaska

[57] ABSTRACT

A transparent/translucent dishwashing composition in bar/paste form containing: (a) an alkyl polyglycoside of the formula I $$R_1(R_2O)_b(Z)_a \quad \text{(I)}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6; (b) a short-chain alcohol; (c) a fatty acid; (d) an amide; and (e) a polyol.

32 Claims, No Drawings

TRANSPARENT DISHWASHING BAR/PASTE COMPRISING ALKYL POLYGLYCOSIDES

This application is a continuation of application Ser. No. 08/613,574 filed on Mar. 11, 1996, now abandoned.

FIELD OF THE INVENTION

This invention relates to transparent dishwashing soap bars. More specifically, the present invention relates to transparent dishwashing bars which exhibit effective lathering and foaming characteristics.

DESCRIPTION OF THE INVENTION

Transparent soap bars are normally milder than opaque bars. These soaps depend for their distinctive appearance upon the fact that soap is deposited from alcoholic solution in a transparent, ultramicrocrystalline form. The incorporation of glycerol and sugars also tend to cause soap to assume this form. The effect is entirely physical, and depends upon the conditions under which the soap crystallizes rather than the presence of alcohol or any other substance in the finished soap cake. Thus, a transparent soap made with the aid of alcohol retains its appearance after most of the alcohol has been evaporated from it.

Transparent soaps vary greatly in composition. They may be prepared simply by dissolving soap flakes in alcohol and then driving off the greater part of the alcohol. Such a product will not be greatly different in composition from the original soap flakes. A more usual method of manufacture, however, is to add alcohol and glycerol, in the proportion of about two parts of alcohol to one of glycerol, to a hot saponified batch of semi-boiled soap until a rapidly cooled sample is clear, after which the batch is framed in the usual way. Sugar may also be added. The fats used in transparent soaps usually are tallow and coconut oil. Up to about 30% castor oil is often used in the fat charge, as the presence of this oil reduces the amount of alcohol, glycerol or sugar required to render the soap transparent. The anhydrous soap content of transparent soaps is usually well under 50%.

There has always been a need to increase the lathering and foaming characteristics of transparent soap bars by inclusion of various types of surfactants. However, it has been found that when a synthetic surfactant is added to a transparent soap formulation, the resulting bar is not transparent.

SUMMARY OF THE INVENTION

The present invention is directed to a dishwashing composition containing:

(a) from about 2 to about 40% by weight of an alkyl polyglycoside of the formula I $$R_1(R_2O)_b(Z)_a \quad (I)$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6;

(b) from about 1 to about 10% by weight of a short-chain alcohol;

(c) from about 2 to about 15% by weight of a fatty acid;

(d) from about 1 to about 20% by weight of an amide; and (e) from about 1 to about 20% by weight of a polyol, all weights being based on the weight of the composition.

The present invention also provides a process for making a dishwashing composition involving combining the above-disclosed components in the disclosed proportions.

DESCRIPTION OF THE INVENTION

Other than in the operating examples, or where otherwise indicated, all numbers expressing quantities of ingredients or reaction conditions are to be understood as being modified in all instances by the term "about".

The alkyl polyglycosides which can be used in the compositions according to the invention have the formula I $$R_1(R_2O)_b(Z)_a \quad (I)$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6. Preferred alkyl polyglycosides which can be used in the compositions according to the invention have the formula I wherein Z is a glucose residue and b is zero. Such alkyl polyglycosides are commercially available, for example, as APG®, GLUCOPON®, or PLANTAREN® surfactants from Henkel Corporation, Ambler, PA., 19002. Examples of such surfactants include but are not limited to:

1. APG® 225 Surfactant—an alkyl polyglycoside in which the alkyl group contains 8 to 10 carbon atoms and having an average degree of polymerization of 1.7.
2. APG® 425 Surfactant—an alkyl polyglycoside in which the alkyl group contains 8 to 16 carbon atoms and having an average degree of polymerization of 1.6.
3. APG® 625 Surfactant—an alkyl polyglycoside in which the alkyl groups contains 12 to 16 carbon atoms and having an average degree of polymerization of 1.6.
4. APG® 325 Surfactant—an alkyl polyglycoside in which the alkyl groups contains 9 to 11 carbon atoms and having an average degree of polymerization of 1.6.
5. GLUCOPON® 600 Surfactant—an alkyl polyglycoside in which the alkyl groups contains 12 to 16 carbon atoms and having an average degree of polymerization of 1.4.
6. PLANTAREN® 2000 Surfactant—a $C_{8-16}$ alkyl polyglycoside in which the alkyl group contains 8 to 16 carbon atoms and having an average degree of polymerization of 1.4.
7. PLANTAREN® 1300 Surfactant—a $C_{12-16}$ alkyl polyglycoside in which the alkyl groups contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms in which and the average carbon chain length of the composition is from about 9 to about 14 comprising a mixture of two or more of at least binary components of alkyl polyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated. The inclusion of alkyl polyglycosides into transparent soap bar formulations containing alkanolamines, polyols, water, and alkali soaps inhibits weeping of water and poyols A preferred alkyl polyglycoside is one wherein in formula I, $R_1$ is a monovalent organic radical having from about 8 to about 16 carbon atoms, b is zero, and a is a number having a value of from 1.4 to 1.7. A particularly preferred alkyl polyglycoside is one wherein in formula I, $R_1$ is a monovalent organic radical having from 12 to 16 carbon atoms, b is zero and a is a number having a value of 1.6. The amount of alkyl polyglycoside that can be used generally ranges from about 2 to about 40% by weight, and preferably from about 5 to about 15% by weight, based on the weight of the composition.

The short-chain alcohol component of the present invention can be any short-chain monohydric alcohol. Suitable short-chain alcohols include, but are not limited to, methyl alcohol, ethyl alcohol, propyl alcohol, and the like. A particularly preferred short-chain alcohol is isopropyl alcohol. The amount of short-chain alcohol that can be employed in the present invention ranges from about 1 to about 10% by weight, based on the weight of the composition.

The polyol component of the soap bars according to the invention can be any aliphatic compound having 2 or more alcohol functionalities. Such polyols include diols, triols, tetraols, etc. Examples of such polyols include, but are not limited to, ethylene glycol, 1,2-propylene glycol, 1,3-propylene glycol, diethylene glycol, dipropylene glycol, triethylene glycol, 1,6-hexylene glycol, glycerine, polyglycerols, monosaccharides such as glucose or fructose, disaccharides such as sucrose, sorbitol, and polyvinyl alcohol. Preferred polyols include 1,2-propylene glycol, glycerine, polyglycerol, and sorbitol. The most preferred polyol is 1,2-propylene glycol. The amount of polyol that can be used is preferably from about 1 to about 20% by weight, and most preferably from about 7 to about 15% by weight, based on the weight of the composition.

The specific amount of polyol employed will depend upon the aesthetic form of the composition desired. For example, if a transparent dishwashing composition is desired, the composition will typically contain from about 8 to about 20, and preferably from about 12 to about 16% by weight of the polyol component, based on the weight of the composition. Conversely, if a translucent dishwashing composition is desired, the composition will typically contain from about 1 to about 10, and preferably from about 3 to about 7% by weight of the polyol component, based on the weight of the composition. A particularly preferred polyol is CARBOWAX®400, a linear poyethylene glycol polymer commercially available from Union Carbide Corporation.

The fatty acid component of the composition according to the invention can be any saturated or unsaturated, branched or linear carboxylic acid having from 8 to 30 carbon atoms or a mixture of such acids. An example of a preferred commercial grade stearic acid is EMERSOL® 150 Stearic Acid, a trademark product of Henkel Corporation, Emery Group, Cincinnati, Ohio, which has an average weight percent composition of 2.0% myristic acid, 1% pentadecanoic acid, 11% palmitic acid, 2.0% margaric acid, and 83% stearic acid. The amount of fatty acid component that can be used in the composition according to the invention generally ranges from about 2 to about 15% by weight, and preferably from about 3 to about 8% by weight, based on the weight of the composition. A particularly preferred fatty acid component is a high grade stearic acid containing more than 50% pure stearic acid, and preferably at least 80% pure stearic acid.

It should be noted, however, that the specific amount of fatty acid employed will depend upon the hardness and, hence, the form of the composition desired. For example, if a dishwashing bar is desired, the composition will typically contain from at least 4% up to about 15% by weight of the fatty acid component. Conversely, if a dishwashing paste is desired, the composition will typically contain less than 4% by weight, and preferably from about 2.5 to about 3.5% by weight of the fatty acid component.

The degree of neutralization of the fatty acids ranges from at least 70% up to 100%, with the most preferred range being from 90 to 100%. The fatty acids can be neutralized using any alkali material such as, for example, sodium hydroxide.

The amides which may be employed in the present invention have the general formula II:

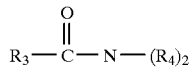

(II)

wherein $R_3$ is an alkyl group containing from about 8 to about 18 carbon atoms and each $R_4$ is the same or different and is selected from the group consisting of hydrogen, $C_{1-3}$ alkyl, $C_{1-3}$ alkanol, and —($C_2H_4O$—), and mixtures thereof. The preferred amide is a diethanolamide, and more particularly, a cocodiethanolamide. It should also be noted that monoethanolamides have been found to be ineffective in formulating the dishwashing compositions of the present invention. The amount of amide to be used in the present invention generally ranges from about 1 to about 20% by weight, and preferably from about 2 to about 6% by weight, based on the weight of the composition.

In a particularly preferred embodiment of the present invention, the dishwashing composition contains from about 8 to about 12% by weight of an alkyl polyglycoside of formula I wherein $R_1$ is a monovalent organic radical having from 12 to 16 carbon atoms, from about 3 to about 5% by weight of isopropylalcohol, from about 4 to about 6% by weight of stearic acid, from about 5 to about 10% by weight of cocodiethanolamide, and from about 10 to about 14% by weight of 1,2-propylene glycol, all weights being based on the weight of the composition. In this embodiment, the dishwashing composition formed is a transparent, solid bar. However, as was noted above, by varying the amount of fatty acid used, in this case using less stearic acid, the composition will take on the form of a paste. Similarly, by varying the amount of polyol used, in this case using more 1,2-propylene glycol, a more translucent dishwashing composition is formed. Regardless of the aesthetic appearance desired, the amount of fatty acid employed will range from about 2 to about 15% by weight, and the amount of polyol employed will range from about 1 to about 20% by weight, all weights being based on the weight of the composition.

It should also be noted that a bar or paste form of the dishwashing composition of the present invention has application in both the institutional and industrial sectors. For example, a bar form of the composition may be packaged in a container capable of being inverted in a downwardly-dispensing direction. By attaching a hot water source to the dispensing end of the container, small amounts of the dishwashing composition can be melted and dispensed, via gravitational pull, onto articles to be cleaned.

Additional dishwashing ingredients may also be incorporated into the composition without departing from the spirit of the invention. Examples thereof include, but are not limited to, anionic surfactants, nonionic surfactants, and builders. However, since the aesthetic appearance of the dishwashing composition is meant to range between transparent and translucent, additives such as those listed above must be chosen with caution so as not to render the composition opaque.

Anionic surfactants which may be employed in the composition of the present invention include linear alkyl sulfonates and ether sulfates.

The sulfonate group, —$SO_3M$ attached to an alkyl, aryl or alkylaryl hydrophobe is a highly effective solubilizing group. Sulfonic acids are strong acids and their salts are relatively unaffected by pH. They are stable to both oxidation and, because of the strength of the C—S bond, also to hydrolysis. They interact moderately with the hardness ions $Ca^{2+}$ and $Mg^{2+}$, significantly less so than carboxylates. Modification of the hydrophobe in sulfonate surfactants, by introduction of double bonds or ester or amide groups into the hydrocarbon chain or as substituents, yields surfactants that offer specific performance advantages.

Because the introduction of the $SO_3H$ function is inherently inexpensive, e.g., by oleum, $SO_3$, $SO_2$, $Cl_2$, or $NaHSO_3$, sulfonates are heavily represented among the high-volume surfactants. While representative sulfonates include alkylarenesulfonates, short-chain lignosulfates, naphthalenesulfonates, alpha-olefinsulfonates, petroleum sulfonates, and sulfonates with ester, amide or ether linkages, the present invention is directed to the use of linear or branched alkyl sulfonates (LAS), i. e., straight- or branched-chain alkylbenzenesulfonates in its surfactant composition. The linear alkylates thereof may be normal, iso (branched at the end only) or highly branched, and must have at least 10 carbon atoms.

The preferred linear alkyl sulfonates of the present invention contain a straight alkyl chain having from about 9 to about 25 carbon atoms, most preferably from about 10 to about 13 carbon atoms, and the cation is sodium, potassium, ammonium, mono-, di-, or triethanolammonium, calcium or magnesium and mixtures thereof. Suitable straight-chain alkylbenzenesulfonates include $C_{10-15}$ alkylbenzenesulfonates. Linear alkyl sulfonates will typically be employed in the composition in an amount ranging from about 5 to about 40, and preferably from 15 to 30% by weight, based on the weight of the composition.

The ether sulfates which may be employed are short-chain alkyl sulfates characterized by the formula $R^1O—SO_4^-—X^+$ wherein $R^1$ is $C_{12-16}$ alkyl radical and X is Na, K, Mg, and $NH_3$. These can be manufactured from alkyl alcohols by sulfation with $SO_3$ or chlorosulfonic acid. Ether sulfates will typically be employed in the composition in an amount ranging from about 1 to about 20%, and preferably from 7 to 14% by weight, based on the weight of the composition.

Nonionic surfactants suitable for use as auxiliaries in the dishwashing composition of the present invention include, for example, alcohol ethoxylates characterized by a carbon chain length of $C_9$–$C_{16}$ having from 5 to 13 moles of ethylene oxide per mole of alcohol.

A particularly preferred alcohol ethoxylate is a nonylphenol ethoxylate having 9 moles of ethylene oxide. Alcohol ethoxylates will typically be employed in the composition in an amount ranging from about 1 to about 20%, and preferably from 5 to 10% by weight, based on the weight of the composition.

Other auxiliaries which may be employed include builders. Particularly preferred builders include urea and/or sugar due to the enhanced tactile properties which they impart onto the dishwashing composition when in contact with human skin. These types of builders will typically be employed in the composition in an amount ranging from about 5 to about 25%, and preferably from 18 to 23% by weight, based on the weight of the composition.

The present invention will be better understood from the examples which follow, all of which are intended to be illustrative only and not meant to unduly limit the scope of the invention. Unless otherwise indicated, percentages are on a weight-by-weight basis.

EXAMPLE

A dishwashing bar in accordance with the present invention was made having the following formulation.

| Component | %/wt. |
|---|---|
| (a) LAS | 35.5 |
| (b) APG ® 625* | 10.0 |
| (c) nonylphenol $(EO)_9$ | 5.25 |
| (d) cocodiethanolamide | 4.0 |
| (e) ether sulfate | 7.5 |
| (f) 1,2-polyethyelene glycol | 10.0 |
| (g) urea | 20.0 |
| (h) stearic acid (80% pure) | 4.0 |
| (i) isopropyl alcohol | 3.0 |
| (j) NaOH | 1.0 |
| | 100.0 |

*APG ® 625 is an alkyl polyglycoside, commercially available from Henkel Corporation, Ambler, PA, in which the alkyl groups contain 12 to 16 carbon atoms and having an average degree of polymerization of 1.6.

The above-listed surfactants were combined and heated to a temperature of about 55° C. The urea was then added to the mixture, with mixing, until it was completely dissolved therein. The stearic acid was then added, with mixing, and once it was all in solution, the stearic acid was then neutralized with the sodium hydroxide. The isopropyl alcohol was then added, with mixing. The resultant solution was then poured into molds and allowed to harden, thus forming a dishwashing bar.

What is claimed is:

1. A transparent/translucent dishwashing composition in bar/paste form comprising:

(a) from 2% to 40% of an alkyl polyglycoside having general formula I $$R_1(R_2O)_b(Z)_a \quad (I)$$

wherein $R_1$ is a monovalent organic radical having from about 6 to about 30 carbon atoms;

$R_2$ is a divalent alkylene radical having from 2 to 4 carbon atoms; Z is a saccharide residue having 5 or 6 carbon atoms; b is a number having a value from 0 to about 12; a is a number having a value from 1 to about 6;

(b) a short-chain alcohol;

(c) from 2% to 15% of a stearic acid component having a degree of neutralization of from at least 70% up to 100%, wherein the stearic acid component contains greater than 50% pure stearic acid;

(d) an amide; and (e) a polyol.

2. The composition of claim 1 wherein in formula I $R_1$ is a monovalent organic radical having from about 8 to about 16 carbon atoms, b is zero, and a is a number having a value of about 1.6.

3. The composition of claim 1 wherein the short-chain alcohol is present in the composition in an amount of from about 1 to about 10% by weight, based on the weight of the composition.

4. The composition of claim 1 wherein the amide is a diethanolamide.

5. The composition of claim 1 wherein the amide is present in the composition in an amount of from about 1 to about 20% by weight, based on the weight of the composition.

6. The composition of claim 1 wherein the polyol is a linear polyethylene glycol.

7. The composition of claim 1 wherein the polyol is present in the composition in an amount of from about 1 to about 20% by weight, based on the weight of the composition.

8. The composition of claim 1 further comprising an auxiliary component selected from the group consisting of an anionic surfactant, a nonionic surfactant other than alkyl polyglycoside, a builder and mixtures thereof.

9. The composition of claim 8 wherein the anionic surfactant is an alkyl benzene sulfonate.

10. The composition of claim 8 wherein the anionic surfactant is an ether sulfate.

11. The composition of claim 8 wherein the anionic surfactant is present in the composition in an amount of from about 3 to about 40% by weight, based on the weight of the composition.

12. The composition of claim 8 wherein the nonionic surfactant is an alcohol ethoxylate.

13. The composition of claim 12 wherein the alcohol ethoxylate is a nonylphenol having 9 moles of ethylene oxide.

14. The composition of claim 8 wherein the nonionic surfactant is present in the composition in an amount of from about 1 to about 20% by weight, based on the weight of the composition.

15. The composition of claim 8 wherein the builder is selected from the group consisting of urea, an additional sugar and mixtures thereof.

16. The composition of claim 8 wherein the builder is present in the composition in an amount of from about 5 to about 25% by weight, based on the weight of the composition.

17. A process for making a transparent/translucent dishwashing composition in bar/paste form comprising combining:

(a) from 2% to 40% of an alkyl polyglycoside having general formula I $$R_1(R_2O)_b(Z)_a \quad (I)$$

wherein $R_1$ is a monovalent organic radical having from about 6 to about 30 carbon atoms;

$R_2$ is divalent alkylene radical having from 2 to 4 carbon atoms; Z is a saccharide residue having 5 or 6 carbon atoms; b is a number having a value from 0 to about 12; a is a number having a value from 1 to about 6;

(b) a short-chain alcohol;

(c) from 2% to 15% of a stearic acid component acid having a degree of neutralization of from at least 70% up to 100%, wherein the stearic acid component contains greater than 50% pure stearic acid;

(d) an amide; and (e) a polyol.

18. The process of claim 17 wherein in formula I $R_1$ is a monovalent organic radical having from about 8 to about 16 carbon atoms, b is zero, and a is a number having a value of about 1.6.

19. The process of claim 17 wherein the short-chain alcohol is present in the composition in an amount of from about 1 to about 10% by weight, based on the weight of the composition.

20. The process of claim 17 wherein the amide is a diethanolamide.

21. The process of claim 17 wherein the amide is present in the composition in an amount of from about 1 to about 20% by weight, based on the weight of the composition.

22. The process of claim 17 wherein the polyol is a linear polyethylene glycol.

23. The process of claim 17 wherein the polyol is present in the composition in an amount of from about 1 to about 20% by weight, based on the weight of the composition.

24. The process of claim 17 further comprising an auxiliary component selected from the group consisting of an anionic surfactant, a nonionic surfactant other than alkyl polyglycoside, a builder and mixtures thereof.

25. The process of claim 24 wherein the anionic surfactant is an alkyl benzene sulfonate.

26. The process of claim 24 wherein the anionic surfactant is an ether sulfate.

27. The process of claim 24 wherein the anionic surfactant is present in the composition in an amount of from about 3 to about 40% by weight, based on the weight of the composition.

28. The process of claim 24 wherein the nonionic surfactant is an alcohol ethoxylate.

29. The process of claim 28 wherein the alcohol ethoxylate is nonylphenol having 9 moles of ethylene oxide.

30. The process of claim 24 wherein the nonionic surfactant is present in the composition in an amount of from about 1 to about 20% by weight, based on the weight of the composition.

31. The process of claim 24 wherein the builder is selected from the group consisting of urea, an additional sugar and mixtures thereof.

32. The process of claim 24 wherein the builder is present in the composition in an amount of from about 5 to about 25% by weight, based on the weight of the composition.

* * * * *